United States Patent [19]

Nishiyama et al.

[11] Patent Number: 5,035,989

[45] Date of Patent: Jul. 30, 1991

[54] SILVER HALIDE PHOTOGRAPHIC MATERIAL FOR REVERSAL PROCESSING

[75] Inventors: Shingo Nishiyama; Naomi Saeki, both of Ashigara, Japan

[73] Assignee: Fuji Photo Film Co., Ltd., Kanagawa, Japan

[21] Appl. No.: 442,036

[22] Filed: Nov. 28, 1989

[30] Foreign Application Priority Data

Nov. 28, 1988 [JP] Japan ..... 63-300181
Nov. 28, 1988 [JP] Japan ..... 63-300182

[51] Int. Cl.[5] ..... G03 1/005

[52] U.S. Cl. ..... 430/567; 430/407; 430/430; 430/603

[58] Field of Search ..... 430/407, 430, 567, 603, 430/598, 445, 434, 599, 603

[56] References Cited

U.S. PATENT DOCUMENTS 4,314,024 2/1982 Gernert ..... 430/564
4,614,711 9/1986 Sugimoto et al. ..... 430/567
4,692,400 9/1987 Kumashiro et al. ..... 430/553
4,883,748 11/1989 Hayakawa ..... 430/567

FOREIGN PATENT DOCUMENTS 0202784 11/1986 European Pat. Off. .
62-105141 5/1987 Japan .
62-105142 5/1987 Japan .

*Primary Examiner*—Charles L. Bowers, Jr.
*Assistant Examiner*—Janis L. Dote
*Attorney, Agent, or Firm*—Sughrue, Mion, Zinn, Macpeak & Seas

[57] ABSTRACT

A silver halide photographic material for reversal processing is disclosed, which comprises a support having provided thereon at least one hydrophilic colloidal layer, the hydrophilic colloidal layer being a light-sensitive silver halide emulsion layer, silver halide grains of the silver halide emulsion being of a core/shell structure comprising a core portion substantially composed of silver bromide and said shell portion substantially composed of silver bromoiodide.

13 Claims, No Drawings

SILVER HALIDE PHOTOGRAPHIC MATERIAL FOR REVERSAL PROCESSING

FIELD OF THE INVENTION

This invention relates to a silver halide photographic material to be used for forming a positive image by reversal development processing and, more particularly, to a high-speed microfilm adapted for reversal development processing which can be used for recording information output from a computer CRT, that is, high-speed COM (Computer Output Microfilm).

BACKGROUND OF THE INVENTION

COM (Computer Output Microfilm) systems using silver halide light-sensitive materials are working throughout the world as one of the systems of recording enormous information output from computers at high speed and in high density and storing it. Microfilms used for this system are called COM films and many kinds of such films are commercially available. COM films generally comprise a photographic support having provided on one side thereof one or more negative-working or direct positive silver halide photographic emulsion layers. These emulsions are generally designed to be of high micro-contrast so as to record a micro-image composed of a fine line copy with high resolving power. That is, they usually have a contrast of 1.5 to 2.5, though varying depending upon processing conditions. Aside from the COM use, information to be recorded on ordinary microfilms is obtained by directly photographing document copies, and hence most information is mainly micro-images composed of a fine line copy. However, a micro-image having a continuous gradation and uniform density must simultaneously be recorded with high quality. Although light-sensitive materials of a high macro-contrast designed to be optimal for recording a fine line copy can record a fine line copy with distinctness and good resolving power, they have the defect that, in recording macro-images, they are of so high a contrast that they naturally show a reduced ability to depict a shadow portion. As a means for overcoming this inconsistency, U.S. Pat. No. 4,924,773 and JP-A-55-33190 (the term "JP-A" as used herein means an "unexamined published Japanese patent application"), for example, disclose the technique of using light-sensitive materials in micro-recording which can be of a comparatively high contrast for micro-images and of a comparatively low contrast for macro-images. In this technique, it is proposed to use a previously surface-fogged silver halide emulsion together with an ordinary negative-working silver halide emulsion as a mixture. It is true that, in ordinary negative-working processing, a comparatively high micro-contrast and a comparatively low macro-contrast can be concurrently attained, but there is involved a fatal defect that, since the previously surface-fogged silver halide emulsion is developable independent of image-wise exposure, the minimum density (Dmin) of unexposed portions inevitably seriously increases. Thus, in the field of micro-light-sensitive materials in which a Dmin value of, preferably, 0.05 or less is required, such light-sensitive materials can never be put into practice.

On the other hand, in the field of microfilms for COM use, although information output on CRT of a computer is mostly of fine line copy and a high micro-contrast is required as is the same with micro-light-sensitive materials for ordinary documents, the demand for macro-contrast is not as severe as for micro-light-sensitive materials for documents. In addition, in COM use, it is required to provide a positive image as an original by reversal processing in view of the copying system's convenience after the processing. Therefore, a reversal developing process has long been employed. Processing steps of the generally well known reversal developing process comprise conducting a negative development using a black-and-white developer (generally called first developer) containing a silver halide solvent (usually NaSCN) and, after stopping the development, successively removing silver deposits in a negative image portion by silver-removing processing (generally using a bleaching solution such as a solution of potassium dichromate or cerium sulfate) without fixing processing, and successively conducting uniform exposure of the remaining, unexposed silver halide, to fog it, and again developing with a black-and-white developer (generally referred to as a second developer) to form a positive image. This reversal development manner is a manner having long been put into practice but, as has been set forth above, the steps are complicated and photographic properties (reversal Dmax, Dmin, sensitivity and gradation) are liable to be greatly changed depending upon processing conditions. These defects are described more specifically below. That is, since a considerably large quantity of a silver halide solvent (generally NaSCN being used in a concentration of 1 g to 6 g/liter) is present in the first developer of the reversal processing, dissolution of silver halide grains proceeds concurrently with development of silver halide grains, and the amount of remaining silver halide in unexposed portions after imagewise exposure is seriously influenced by processing conditions, composition, dilution ratio and fatigue degree of the first developer. Namely, photographic properties to be finally obtained, particularly reversal Dmax, directly depend upon the amount of remaining silver halide after the first development. In addition, photographic properties other than Dmax, particularly sensitivity and gradation, in this process are greatly influenced by the reversal Dmax. Hence, it has been eagerly desired in view of attaining stable processing to prepare a light-sensitive material which undergoes markedly slight or almost no changes in reversal Dmax even when types or formulations of processing solutions or the fatigue degree of the solutions are changed. In short, in view of the current market demand for microfilms used as COM which are adapted for high-speed, high-density recording of computer-output information, a light-sensitive material which can provide high-speed, high-quality micro-image properties for a short-time exposure of CRT and a high micro-contrast in, particularly, fine line recording and concurrently possesses excellent stability in processing and processing toughness in reversal accelerated processing has been desired.

In addition, in COM use, a high speed is required due to the peculiarity of the light source (CRT). However, conventional films for use as COM have insufficient sensitivity.

On the other hand, as a general technique for raising sensitivity of silver halide light-sensitive materials, there is a technique of enlarging the size of silver halide grains. However, enlarged silver halide grains provide a silver image having a decreased resolving power. This decrease in resolving power is a fatal defect in view of the use in microfilms.

Thus, appearance of high-speed microfilms with high resolving power for use as COM has eagerly been desired.

SUMMARY OF THE INVENTION

It is, therefore, an object of the present invention to provide a microfilm for use as COM which can overcome the above-described inconsistent problems, which is of high speed and concurrently of a relatively high micro-contrast and of a low Dmin in the microfilm field wherein positive images are formed by reversal processing and which is stable against change in solution composition or solution temperature upon reversal development and possesses an extremely wide tolerance.

It has been found that the above-described object can be attained by improving the properties of the silver halide grains to be used. That is, contrast of a micro-image obtained by reversal development processing is found to greatly depend upon grain size, mono-disperse degree, content of AgI of grains, and iodide distribution in the grains of a starting emulsion, and desirable results are found to be obtained by smaller grain size, smaller mono-disperse degree in terms of coefficient of variation (CV), and smaller average content of iodide in grains. On the other hand, sensitivity for high speed recording of CRT-output information shows a contradictory behavior as to grain size and silver iodide content, i.e., sensitivity decreases as the grains size and silver iodide content are reduced. Further, as to stability of Dmax obtained by reversal processing, too, all factors favorable for improvement of micro-contrast are found to be adverse for the stability and contradictory with factors favorable for improvement of the stability.

As a result of intensive investigations, the above-described object of the present invention is attained by providing a silver halide photographic material for reversal processing, which comprises a support having provided thereon at least one hydrophilic colloidal layer, said at least one hydrophilic colloidal layer being a light-sensitive silver halide emulsion layer, silver halide grains of said silver halide emulsion being of a core/-shell structure comprising a core portion and a shell portion, and said core portion being substantially composed of silver bromide and said shell portion being substantially composed of silver bromoiodide.

DETAILED DESCRIPTION OF THE INVENTION

As used throughout this application, the term "a micro-image" refers to a thin image of less than 100 μm in width, such as line print and the like, and the term "a macro-image" refers to a thick image greater than 100 μm in width. Similarly, the term "micro-contrast" refers to the contrast of a thin image less than 100 μm in width. The term "relatively high contrast" is defined as a contrast greater than or equal to 1.5, and the term "relatively low contrast" is defined as a contrast less than 1.5. In this specification, the standard point for the measurement of contrast is a point of minimum density (Dmin) +0.10 in density on the characteristic curve with silver density (D) obtained by reversal development as the ordinate and exposure amount (Log E) as the abscissa.

In order to improve micro-contrast, it is a first consideration to improve the degree of monodispersion of the silver halide emulsion grains. In addition, this must be attained stably on an industrial scale. The use of AgBr cores or cores substantially composed of AgBr serves to accomplish such stability. The term "substantially" as used with respect to the amount of AgBr means that silver iodide or silver chloride or both are present in a concentration of less than 0.5 mol %. If content of silver iodide and/or silver chloride exceeds 0.5 mol %, the probability of twin generation greatly increases and inclusion of large-sized grains becomes inevitable. This tendency becomes even more remarkable as the production scale of the emulsion is enlarged, and hence the use of cores substantially composed of AgBr is of extreme importance in view of the stable production of the emulsion on an industrially large scale.

Cores are not particularly limited as to size, but sizes of 0.1 μm to less than 0.2 μm are preferable. If the sizes are less than 0.1 μm, the system becomes unstable whereas, if the sizes are 0.2 μm or more, disadvantageous photographic speed results. Appearance of crystals of the cores are not particularly specified, but cores of a {1 1 1} face are preferred. Cores of a {1 0 0} or a {1 0 0}+{1 1 1} face are liable to undergo a change in the size of the final grains, thus being unfavorable in view of production stability. As to crystal habit, not twins but normal crystals are preferred in view of degree of mono-dispersion.

The shell portion of the silver halide grains of the present invention substantially comprises silver bromoiodide. Silver halide "substantially comprising" silver bromoiodide refers to silver bromoiodide containing 0 to less than 0.5 mol% of silver chloride and containing 0.5 mol % or more, particularly 0.5 to 6 mol %, more preferably 1.0 to 2.5 mol %, of silver iodide.

The ratio of silver amount of the core portion to that of the shell portion ranges preferably from 1/1 to 1/10 (by molar ratio), more preferably from 1/1 to ⅛, particularly preferably from ½ to 1/6.

The shell portion of the silver halide grains of the present invention preferably comprises two or more layers, more preferably two layers. In the case, it is preferred that the inner shell portion i.e., the layer adjacent to the core (first shell portion) substantially comprises silver bromoiodide and the outer shell portion (second shell portion) substantially comprises silver bromide.

Where the shell portion comprises two layers, the inner portion should be preferably of silver bromoiodide containing 1.0 to 6.0 mol %, preferably 1.0 to 5.0 mol %, more preferably 2.0 to 4.0 mol %, of silver iodide, and the outer portion should be preferably of silver bromide or silver bromoiodide containing 0.5 mol % or less of silver iodide, with silver bromide being particularly preferable. It is preferred that the difference in silver iodide content between the inner portion and the outer portion be less than 6 mol %.

The first shell portion accounts for preferably 20 to 60 mol %, particularly preferably 30 to 50 mol %, based on the whole grain.

The second shell portion accounts for preferably 20 to 50 mol %, particularly preferably 30 to 40 mol %, based on the whole grain.

The second shell portion may have enough thickness to substantially shield the minus effect (on chemical sensitization, development progress, etc.) of silver iodide contained in a high concentration in the first shell portion but, if too thick, the volume of the first shell portion is decreased when the size of the whole grain is specified, which leads to a substantial increase in AgI content of the first shell portion, thus the shielding becomes rather difficult. Therefore, there naturally exists an optimal thickness. Formation of the second shell portion is desirably conducted under a relatively low pAg condition (generally from 3 to 4) under which a {1 0 0} face develops well.

Formation of the first shell portion is desirably conducted under a relatively low pAg condition under which a {1 0 0} face develops well in view of finally obtaining cubic grains.

One purpose of concentrating AgI in the first shell portion resides in delaying dissolution of silver halide grains with NaSCN or the like contained in the first developer without spoiling chemically sensitizable properties and without spoiling developability in the first development of reversal processing. This technique has enabled stable reversal processing to be ensured without sacrificing developability. Another purpose of concentrating AgI in the first shell portion resides in increasing the amount of light absorbed by the whole grain to thereby enhance sensitivity, thus both developability and processing stability are obtained without sacrificing sensitivity.

The size of silver halide grains of the purpose invention should be preferably 0.1 to 1.0 μm, more preferably 0.1 to 0.7 μm, most preferably 0.2 to 0.4 μm, and content of silver iodide based on the whole grain should be preferably 0.5 to 5 mol %, more preferably 1 to 4 mol %, most preferably 1 to 2 mol %.

As to the appearance of the crystals of the final grains, a {1 1 0} face and/or a {1 1 1} face may be involved, but a {1 0 0} face is particularly preferable.

As to crystal habit, normal crystals and single twins are preferable and, in view of the degree of monodispersion, independent normal crystals are particularly preferable.

The phrase "appearance of the crystal" as used herein means an external form of crystal determined by the crystal face constituting the crystal surface, and the term "crystal habit" means an external form determined by the structure of the crystal.

The silver halide grains of the present invention are preferably so-called mono-disperse grains, with the coefficient of variation (CV) being preferably up to 20%, more preferably 5 to 15%, most preferably 6 to 13%.

The core/shell type grains of the present invention are not particularly limited to only one process for their preparation, and general processes may be employed. However, cores are preferably prepared under the conditions of 0.8 to 9.2 in pAg and 4.8 to 6.0 in pH, and shell portions are preferably prepared under the conditions of 6.8 to 7.8 in pAg and 4.8 to 6.0 in pH.

The coating amount of silver halide in the present invention is not particularly limited, and is preferably 0.5 to 5.0 g/m$^2$, more preferably 1.0 to 2.5 g/m$^2$ as silver.

The silver halide emulsions may be used as so-called primitive emulsions without conducting chemical sensitization, but are usually chemically sensitized. Chemical sensitization can be conducted according to the processes described, for example, in the aforesaid books by P. Glafkides, *Chimie et Physique Photographique* (Paul Montel Co., 1967) or by V. L. Zelikman et al, *Making and Coating Photographic Emulsion* (The Focal Press, 1964) or in H. Frieser, *Die Grundlagen der Photographischen Prozesse mit Silberhalogeniden* (Akademische Verlagsgesellschaft, 1968).

That is, sulfur sensitization using compounds such as thiosulfates, thioureas, thiazoles and rhodanines or active gelatin, reduction sensitization using stannous salts, amines, hydrazines, formamidinesulfinic acid, silane compounds, etc. and noble metal sensitization using complex salts of metals of group VIII in the periodic table (e.g., platinum, iridium or palladium) as well as gold complex salts can be employed alone or in combination.

In addition, the emulsions may contain, for example, thioether compounds, thiomorpholine compounds, quaternary ammonium salt compounds, urethane derivatives, urea derivatives, imidazole derivatives and 3-pyrazolidones for the purpose of enhancing sensitivity and contrast or accelerating development. For example, those which are described in U.S. Pat. Nos. 2,400,532, 2,423,549, 2,716,062, 3,617,280, 3,772,021, 3,808,003, etc. may be used.

In the present invention, gelatin is advantageously used as a binder or protective colloid for photographic emulsion layers. However, other hydrophilic colloids can be used as well. For example, proteins such as gelatin derivatives, graft polymers between gelatin and other high polymers, albumin, casein, etc.; cellulose derivatives such as hydroxyethylcellulose, carboxymethylcellulose, cellulose sulfate, etc.; sugar derivatives such as sodium alginate, starch derivatives, etc.; and various synthetic hydrophilic macromolecular substances such as homopolymers or copolymers (e.g., polyvinyl alcohol, partially acetallized polyvinyl alcohol, poly-N-vinylpyrrolidone, polyacrylic acid, polymethyacrylic acid, polyacrylamide, polyvinylimidazole, polyvinylpyrrazole, etc.) may be used.

As for gelatin, acid-processed gelatin may be used as well as lime-processed gelatin, and a gelatin hydrolyzate or an enzymedecomposed gelatin can also be used.

Incorporation of a compound represented by the following formula (I) in a light-sensitive emulsion layer or other hydrophilic colloidal layer of the photographic material in accordance with the present invention serves to attain high sensitivity and high resolving power, thus being preferable:

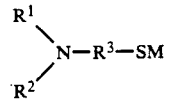

(I)

wherein $R^1$ and $R^2$ each represents a hydrogen atom or an aliphatic residue, or $R^1$ and $R^2$ may be bound to each other to form a ring, $R^3$ represents a divalent aliphatic group, and M represents a hydrogen atom, an alkali metal atom, an alkaline earth metal atom, a quaternary ammonium salt, a quaternary phosphonium salt or an amidino group.

In formula (I), $R^1$ and $R^2$ each represents a hydrogen atom or an aliphatic residue. The aliphatic residue includes, for example, an alkyl, alkenyl or alkynyl group containing up to 12 carbon atoms, each of which may be substituted by a substituent. The alkyl group includes, for example, a methyl group, an ethyl group, a propyl group, a butyl group, a hexyl group, a decyl group, a dodecyl group, an isopropyl group, a secbutyl group, and a cyclohexyl group. The alkenyl group includes, for example, an allyl group, a 2-butenyl group, a 2-hexenyl group, and a 2-octenyl group. The alkynyl group includes, for example, a propargyl group and a 2-pentynyl group. Examples of the substituents include a phenyl group, a substituted phenyl group, an alkoxy group preferably having an alkyl moiety of 1 to 4 carbon atoms such as a methoxy group and an ethoxy group, an alkylthio group preferably having an alkyl moiety of 1 to 4 carbon atoms such as a methylthio group and an ethylthio group, a hydroxy group, a carboxyl group, a sulfo group, an alkylamino group preferably having an alkyl moiety of 1 to 4 carbon atoms such as a methylamino group and an ethylamino group, and an amido group. The ring formed by $R^1$ and $R^2$ is a 5- or 6-membered carbon ring or hetero ring composed of carbon or a combination of carbon, nitrogen and oxygen, such as

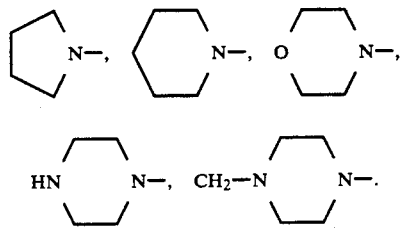

Preferable examples of $R^1$ and $R^2$ are a hydrogen atom and an alkyl group containing 1 to 3 carbon atoms, more preferably a hydrogen atom, a methyl group and an ethyl group.

The divalent aliphatic group represented by $R^3$ includes a saturated and unsaturated, straight or branched aliphatic hydrocarbyl group such as $-CH_2-$, $-CH_2CH_2-$, $-(CH_2)_3-$, $-(CH_2)_4-$, $-(CH_2)_6-$, $-CH_2CH{=}CHCH_2-$, $-CH_2C{\equiv}CCH_2-$, $$-CH_2\overset{\overset{\displaystyle CH_3}{|}}{C}HCH_2-.$$

Preferable numbers of carbon atoms in $R^3$ is 2 to 4, and $R^3$ more preferably represents $-CH_2CH_2-$ or $-CH_2CH_2CH_2-$.

M represents a hydrogen atom, an alkali metal atom (e.g., $Na^+$, $K^+$ or $Li^+$), an alkaline earth metal atom ($Ca^{++}$ or $Mg^{++}$), a quaternary ammonium salt preferably containing 4 to 30 carbon atoms (e.g., $(CH_3)_4N^+$, $(C_2H_5)_4N^+$, $(C_4H_9)_4N^+$, $C_6H_5CH_2N^+(CH_3)_3$, and $C_{16}H_{33}N^+(CH_3)_3$) or a quaternary phosphonium salt (e.g., $(C_4H_9)_4P^+$, $C_{16}H_{33}P^+(CH_3)_3$ or $C_6H_5CH_2P^+(CH_3)_3$) or an amidino group. As strong acid salts of the compounds of general formula (I), there are illustrated hydrochlorides, sulfates, p-toluenesulfonates and methanesulfonates.

Of the compounds represented by formula (I), preferable examples are illustrated below.

(1) $NH_2CH_2CH_2SH.HCl$
(2) $(CH_3)_2NCH_2CH_2SH.HCl$
(3) $(CH_3CH_2)_2NCH_2CH_2SH.HCl$
(4) $(CH_3)_2NCH_2CH_2CH_2SH.HCl$
(5) $(CH_3CH_2)_2NCH_2CH_2CH_2SH.HCl$ (6) $$\begin{matrix} CH_3 \\ \diagdown \\ \qquad NCH_2CH_2SH.HCl \\ \diagup \\ CH_3CH_2 \end{matrix}$$

The compounds represented by formula (I) may be added to a light-sensitive emulsion layer and/or other hydrophilic colloidal layers (e.g., surface-protecting layer, interlayer and subbing layer), preferably to an emulsion layer.

The compounds represented by formula (I) may be added in an amount of preferably 0.05 to 5 $mg/m^2$ and more preferably 0.1 to 1 $mg/m^2$.

The compounds represented by formula (I) are compounds known as bleaching accelerators for color photographic materials as described in U.S. Pat. Nos. 3,893,858 and 3,772,020. It was, however, unexpected that they would show a sensitizing effect in black-and-white photographic materials.

It was particularly unexpected that the compounds of formula (I) showed a marked sensitizing effect in films for use as COM to be subjected to reversal development processing.

The photographic material of the present invention may contain in its light-sensitive emulsion layer or other hydrophilic colloidal layer various known surfactants for various purposes, e.g., as a coating aid, for preventing the generation of electrostatic charges, for improving lubricating properties, for emulsifying or dispersing, for preventing adhesion and for improving the photographic properties (for example, acceleration of development, increasing contrast or sensitization), etc.

For example, nonionic surfactants such as saponin, glycidol derivatives (such as alkenylsuccinic acid polyglycerides), aliphatic esters of polyhydric alcohols, alkyl esters of saccharide, urethanes or ethers; anionic surfactants such as triterpenoid type saponin, alkyl carboxylates, alkyl benzenesulfonates, alkyl sulfates, alkyl phosphates, N-acyl-N-alkyltaurines, sulfosuccinates, sulfoalkyl polyoxyethylene alkylphenyl ethers; amphoteric surfactants such as amino acids, aminoalkylsulfonic acids, aminoalkylsulfuric acid esters, aminoalkylphosphoric acid esters, alkylbetaines, amineimides or amine oxides; and cationic surfactants such as alkylamine salts, aliphatic or aromatic quaternary ammonium salts, heterocyclic quaternary ammonium salts (such as pyridinium or imidazolium salts) or phosphonium or sulfonium salts containing an alicyclic or heterocyclic ring can be used. Fluorine-containing surfactants are preferably used for antistatic purposes.

The photographic material of the present invention can contain in its light-sensitive emulsion or other hydrophilic colloidal layers a dispersion of a synthetic polymer which is insoluble or slightly soluble in water for the purpose of improving the dimensional stability, or the dispersion may be added for other purposes. Examples of polymers which can be used include polymers composed of one or more alkyl acrylates or methacrylates, alkoxyalkyl acrylates or methacrylates, glycidyl acrylates or methacrylates, acrylamides or methacrylamides, vinyl esters (for example, vinyl acetate), acrylonitirile, olefins and styrene, etc., and polymers comprising a combination of the above-described monomers and acrylic acid, methacrylic acid, $\alpha,\beta$-unsaturated dicarboxylic acids, hydroxyalkyl acrylates or methacrylates, sulfoalkyl acrylates or methacrylates, or styrene-sulfonic acid, etc.

An organic or inorganic hardener may be present in any of the light-sensitive emulsion layers or other hydrophilic colloidal layers of the photographic material of the present invention. For example, chromium salts (such as chrome alum or chromium acetate), aldehydes (such as formaldehyde, glyoxal or glutaraldehyde), N-methylol compounds (such as dimethylolurea or methyloldimethylhydantoin), dioxane derivatives (such as 2,3-dihydroxydioxane), active vinyl compounds (such as 1,3,5-triacryloyl-hexahydro-s-triazine or bis(-vinylsulfonyl)methyl ether), active halogen compounds (such as 2,4-dichloro-6-hydroxy-s-triazine), mucohalic acids (such as mucochloric acid or mucophenoxychloric acid), isoxazoles, dialdehyde starch, 2-chloro-6-hydroxytriazinylated gelatin and the like can be used individually or in combination.

The light-sensitive emulsions of the present invention may be spectrally sensitized with methine dyes or the like. Examples of suitable dyes which can be used include cyanine dyes, merocyanine dyes, complex cyanine dyes, complex, merocyanine dyes, holopolar cyanine dyes, hemicyanine dyes, styryl dyes and hemioxonal dyes. Particularly useful dyes are those dyes which belong to merocyanine dyes and complex merocyanine dyes. These dyes may contain nuclei commonly used as basic heterocyclic nuclei in cyanine dyes. Namely, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus or a pyridine nucleus; nuclei wherein an alicyclic hydrocarbon ring is fused to the above-described nuclei; and nuclei wherein an aromatic hydrocarbon ring is fused to the above-described nuclei, such as an indolenine nucleus, a benzindolenine nucleus, an indole nucleus, a benzoxazole nucleus, a naphthothiazole nucleus, a benzothiazole nucleus, a naphthothiazole nucleus, a benzoselenazole nucleus, a benzimidazole nucleus, a quinoline nucleus, etc. can be employed. These nuclei may be substituted with substituents on the carbon atoms thereof.

The merocyanine dyes or complex merocyanine dyes may contain 5- or 6-membered heterocyclic rings such as a pyrazolin-5-one nucleus, a thiohydantoin nucleus, a 2-thioxazolidin-2,4-dione nucleus, a thiazolidin-2,4-dione nucleus, a rhodanine nucleus or a thiobarbituric acid nucleus, etc.

The photographic material of the present invention may contain in its hydrophilic colloidal layer water-soluble dyes (such as oxonol dyes, hemioxonol dyes, styryl dyes, merocyanine dyes, cyanine dyes and azo dyes) as filter dyes or for the purpose of preventing irradiation or for other various purposes.

The photographic material of the present invention may contain known antifoggants or stabilizers. Examples of antifoggants or stabilizers which can be used include mercapto compounds, benzothiazolium salts, nitroindazoles, nitrobenzimidazoles, chlorobenzimidazoles, bromobenzimidazoles, aminotriazoles, benzotriazoles, nitrobenzotriazoles, benzenethiosulfonic acids, benzenesulfinic aids, benzenesulfonic acid amides, azaindens (for example, triazaindenes, tetrazaindenes (particularly 4-hydroxy-substituted (1,3,3*a*,7)-tetrazaindenes)), etc.

The silver halide photographic material of the present invention may contain two or more silver halide emulsion layers and may further have a surface-protecting layer, an interlayer, an antihalation layer, a backing layer, etc.

It is particularly preferable to provide a dye-free gelatin layer between a silver halide emulsion layer and a support.

The gelatin layer may contain hydroquinone or its derivative, resorcin, catechol, DIR-hydroquinone, etc. in addition to gelatin, and has a thickness of preferably 0.5 to 1.5 μm.

The backing layer of the photographic material of the present invention preferably contains an antistatic agent, a matting agent, etc.

As the antistatic agent, fine particles of a conductive metal oxide (e.g., $SnO_2$ doped with antimony), a fluorine-containing surfactant, a conductive polymer, etc. are preferable and, as the matting agent, PMMA, $SiO_2$ etc. of 1 to 10 μm in particle size are preferable.

Typical supports for use in the photographic material of the present invention include cellulose nitrate films, cellulose acetate films, polyvinyl acetal films, polystyrene films, polyethylene terephthalate films and other polyesters as well as glass, paper, metals and wood.

Imagewise exposure to light for obtaining a photographic image can be performed in a usual manner. Namely, various known light sources such as natural light (sunlight), tungsten lamp, a fluorescent lamp, a mercury lamp, a xenon arc lamp, a carbon arc lamp, a xenon flash lamp or a cathode ray tube flying spot can be used. The exposure time can, of course, be about 1/1,000 sec to about 1 second which is manually employed with cameras, and further, exposure for shorter than about 1/1,000 sec., for example, about $1/10^4$ to about $1/10^6$ sec which is employed in cases using a xenon flash lamp or cathode ray tube and exposure for longer than about 1 sec can be employed.

In the photographic processing of the photographic material of the present invention, any of known reversal development processing for forming a silver image may be employed. As processing solutions, known ones may be used. The processing temperature is usually selected between 18° C. and 50° C., but temperatures lower than 18° C. or higher than 50° C. may be used.

The reversal development processing usually comprises the following steps: first development-washing with water-bleaching-cleaning-overall exposure-second development-fixing-washing with water-drying.

The developer to be used for the first black-and-white photographic processing may contain known developing agents. As the developing agents, dihydroxybenzenes (e.g., hydroquinone), 3-pyrazolidones (e.g., 1-phenyl-3-pyrazolidone), aminophenols (e.g., N-methyl-p-aminophenol), 1-phenyl-3-pyrazolines, ascorbic acid, heterocyclic compounds wherein a 1,2,3,4-tetrahydroquinoline ring is fused with an indolenine ring and which are described in U.S. Pat. No. 4,067,872, and the like may be used independently or in combination. In particular, a combined use of a dihydroxybenzene and a pyrazolidone and/or an aminophenol is preferred. In general, the developer may further contain known preservatives, alkali agents, pH buffers, antifoggants, etc. and, if necessary, may contain dissolving aids, toning agents, development accelerators, surfactants, defoaming agents, water softeners, hardeners, viscosity-imparting agents, etc. The photographic material of the present invention is usually processed with a developer containing a sulfite ion in a concentration equal to or greater than 0.15 mol/liter as a preservative.

The pH of the developer is preferably 9 to 11, more preferably 9.5 to 10.5.

In the first developer, a silver halide solvent is used such as NaSCN in a concentration of 0.5 to 6 g/liter.

In the second developer, an ordinary black-and-white development processing solution may be used. That is, the second developer may have the same formulation as the first developer except for omitting the silver halide solvent. The second developer has a pH of preferably 9 to 11, more preferably 9.5 to 10.5.

In the bleaching solution, a bleaching agent may be used such as potassium dichromate or cerium sulfate.

In the fixing solution, a thiosulfate or a thiocyanate is preferably used. If necessary, a water-soluble aluminum salt may be incorporated into the fixing solution.

The present invention is now illustrated in greater detail by reference to the following examples which, however, are not to be construed as limiting the present invention in any way.

EXAMPLE 1

Five kinds of test emulsions (A to D) were prepared in the following manner including comparative emulsions.

1) Preparation of emulsion

Solutions I, II, III and IV shown below were prepared, and solutions II, III and IV were added to solution I according to the pattern shown in Table 1. That is, solutions II, III and IV were added to solution I (pH 5.4) which was well stirred at 75° C. according to the triple jet process, while controlling the pAg of solution I to the values shown in Table 1 by controlling the flow rate of solution III during the addition. Total amounts of solutions II and IV were added at constant rates as shown in Table 1, and solution III was added in an amount equal to or greater than the amount necessary for controlling the pAg, with addition of solution III being stopped upon completion of the addition of solutions II and IV.

Test emulsions A to D were prepared under the same conditions except for the timing and addition periods being changed.

After completion of the addition, respective emulsions were successively subjected to a water-washing step to desalt according to the flocculation process, 100 g of inert gelatin were added thereto per mol of silver halide, and the pAg value and pH value of each emulsion were adjusted to 8.9 and 7.0 at 40° C., respectively, with KBr and NaOH. Thereafter, each emulsion was heated to 75° C., and 310 mg of spectrally sensitizing dye I and 35 mg of spectrally sensitizing dye II were simultaneously added thereto per mol of silver halide and adsorbed onto the silver halide grains. Further, 38.0 mg of sodium thiosulfate and 38.0 mg of chloroauric acid tetrahydrate were added thereto per mol of silver halide, and the emulsions were ripened at the same temperature for 40 minutes to conduct spectral sensitization and chemical sensitization, thus test emulsions A to D were finally obtained. All of these emulsions were cubic mono-disperse emulsions finally containing grains of about 0.36 μm on a side wherein the core portion contained octahedral grains of about 0.16 μm. The formulation and structure of emulsions A to D are shown in Table 2 below. Further the degree of dispersion in terms of coefficient of variation (value obtained by dividing the average side length by the standard deviation value and increasing the calculated value by 100 times) is tabulated in Table 5.

| | |
|---|---|
| Solution I: 75° C. | |
| Inert gelatin | 20 g |
| KBr | 4 g |
| Phosphoric acid aqueous solution (10%) | 2 ml |
| Sodium benzenesulfinate | $5 \times 10^{-2}$ mol |
| 2-Mercapto-3-4-methylthiazole | $1 \times 10^{-2}$ mol |
| $H_2O$ to make | 1000 ml |
| Solution II: 50° C. | |
| Silver nitrate | 170 g |
| $H_2O$ to make | 1000 ml |
| Solution III: 50° C. | |
| KBr | 230 g |
| $H_2O$ to make | 1000 ml |
| Solution IV: 50° C. | |
| KI | 2.6 g |
| $H_2O$ to make | 500 ml |

Spectrally sensitizing dye I

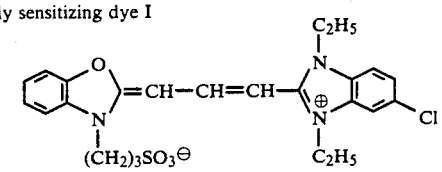

Spectrally sensitizing dye II

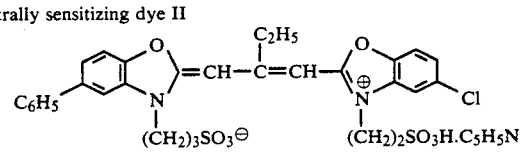

TABLE 1

| Grain-forming Stage | Pattern of adding solutions for obtaining test emulsions A to D: Core Formation | 1st Shell Formation | 2nd Shell Formation |
|---|---|---|---|
| Addition period (min) | 0 — 5 | 5 — 25 | 25 — 40 |
| pAg target value | 8.7 | 7.2 | |
| Solution II (A to E) | continuous addition at a constant rate*1 | | |
| Solution III (A to E) | continuous addition with controlling pAg | | |

TABLE 1-continued

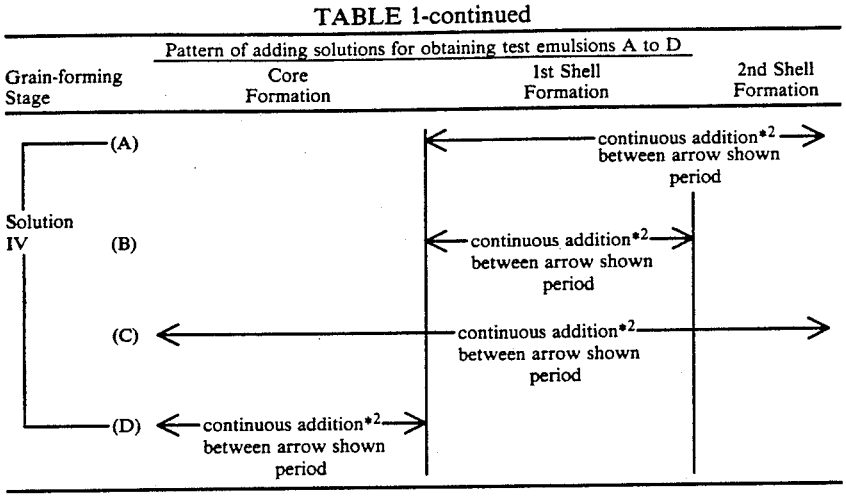

(Note)
*1 2.5 ml/min
*2 constant addition rates of 14.3 ml/min, 25.0 ml/min, 12.5 ml/min and 100.0 ml/min for preparation of Emulsions A, B, C and D, respectively

TABLE 2

| Emulsion | Core Size (μm) | Core AgI Content (mol %) | 1st Shell Shell Thickness (μm) | 1st Shell AgI Content (mol %) | 2nd Shell Shell Thickness (μm) | 2nd Shell AgI Content (mol %) | Final Size (μm) | Average AgI Content (mol %) |
|---|---|---|---|---|---|---|---|---|
| A (Invention) | 0.16 | 0 | 0.10 | 1.9 | None | — | 0.36 | 1.56 |
| B (Invention) | " | " | 0.06 | 3.9 | 0.04 | 0 | " | " |
| C (Comparison) | " | 1.5 | 0.10 | 1.5 | None | — | " | " |
| D (Comparison) | " | 8.9 | 0.10 | 0 | None | — | " | " |

2) Preparation of coated samples

Test samples were prepared by coating the following compositions as shown in Table 3, wherein only silver halide emulsions were varied.

TABLE 3

| Layer | Additive | Coated Amount (mg/m$^2$) | Thickness of Coated Layer |
|---|---|---|---|
| Coated layer | Inert gelatin | 1000 | 0.8 μm |
| | 3 | Barium strontium sulfate 32 | |
| (surface-protecting layer) | Liquid paraffin | 83 | |
| | Colloidal silica | 220 | |
| | Sodium dodecylbenzene sulfonate | 15 | |
| Coated layer 2 (emulsion layer) | Silver halide emulsion (A to D) | 1700 as Ag | 2.5 μm |
| | Inert gelatin | 460 | |
| | 4-Hydroxy-6-methyl-1,3,3,3a-tetrazaindene | 30 | |
| | 1,3-Divinylsulfonyl-2-propanol | 100 | |
| Coated layer 1 (gelatin layer) | Inert gelatin | 500 | 0.5 μm |
| | Hydroquinone | 50 | |
| | Hydroquinone | 50 | |
| | 4-Methyl-4-hydroxymethyl-1-phenyl-3-pyrazolidone | 50 | |
| Support | Polyethylene terephthalate film having a conductive coated layer composed of $SnO_2$ containing Sb | | 100μ |

3) Evaluation of the coated samples a. Imagewise exposure

Imagewise exposure was conducted in a slit exposure of 10 μm in line width from the emulsion-coated side under safelight through a continuous density wedge for $10^{-4}$ second using a xenon flash sensitometer, MARK-II (made by E.G. & G of USA).

b. Reversal development processing

Reversal development processing was conducted under the following conditions as shown in Table 4, using commercially available reversal processing solutions (FR-531, 532, 533, 534, 535; made by FR Chemicals Co. of U.S.A.) by means of a deep-tanked automatic developing machine for reversal processing, F-10R (made by Allen Products Co. of U.S.A.).

TABLE 4

| Step | Processing Solution | Temperature | Time |
|---|---|---|---|
| 1. First developer | FR-531 (1:3)* | 35° C. | 30 sec |
| 2. Washing with water | Running water | " | " |
| 3. Bleaching | FR-532 (1:3) | " | " |
| 4. Cleaning | FR-533 (1:3) | " | " |
| 5. Exposure to light | — | — | — |
| 6. Second developer | FR-534 (1:3) | 35° C. | 30 sec |
| 7. Fixing | FR-535 (1:3) | " | " |
| 8. Washing with water | Spray | " | " |
| 9. Drying | — | — | — |

(Note)* "(1:3)" means that one liter of each stock solution was diluted with 3 liters of water.

c. Measurement of reversal properties

Characteristic properties of the respective imagewise exposed samples having been subjected to the reversal development processing in b) above were read from characteristic curves of black density values measured by means of an automatic recording densitometer and plotted versus logarithmic exposure amount (log E), and were comparatively evaluated. The results thus obtained are tabulated in Table 5.

TABLE 5

| Emulsion | Characteristic properties of emulsions: Grain Size (μm) | Coefficient of Variation CV % *1 | Reversal Sensitivity $S_{0.2}$ | 10 μm Width Micro-contrast $G_{1.0}$ | Reversal Dmin | Reversal Dmax *3: Fresh Solution | Reversal Dmax *3: Fatigued Solution | Change in Dmax, ΔDmax *2 |
|---|---|---|---|---|---|---|---|---|
| A (Invention) | 0.36 | 8.1 | 150 | 1.8 | 0.06 | 2.1 | 1.9 | −0.1 |
| B (Invention) | " | 8.3 | 200 | 2.0 | 0.05 | 2.0 | 2.0 | 0 |
| C (Comparison) | " | 9.5 | 100 | 1.5 | 0.06 | 1.8 | 1.6 | −0.2 |
| D (Comparison) | " | 15.3 | 150 | 0.8 | 0.08 | 1.5 | 1.2 | −0.3 |

(Note)

*1 $CV (\%) = \frac{\text{Standard Deviation}}{\text{Average Length of Grain Side}} \times 100$

*2 ΔDmax = Dmax (fatigued solution) − Dmax (fresh solution)

*3 As a fresh solution, a new solution not used before for each step described in Table 4 was used and, as a fatigued solution, a solution having been used for processing about 110 $m^2$ (105 cm × 75 m × 14 rolls) of a commercially available COM film (Fuji COM-SE) was used.

As is clear form the comparison of characteristics values of emulsions A to D, it is confirmed that, when subjected to reversal processing, emulsions A and B of the present invention show higher sensitivity and higher micro-contrast than comparative emulsions C and D, with reversal Dmin being low and undergoing extremely slight or no decrease in reversal Dmax when processed with the fatigued solution.

It is seen with samples using comparative emulsions C and D, that emulsion C providing high micro-contrast undergoes a serious decrease in reversal Dmax, and emulsion D having high sensitivity provides a low micro-contrast and undergoes a serious change in reversal Dmax.

As is apparent from the above-described experimental results, emulsions A and B of the present invention are superior to any of comparative emulsions C and D in reversal sensitivity, micro-contrast, reversal Dmin, reversal Dmax, and reduction of reversal Dmax due to fatigue of the processing solution.

EXAMPLE 2

An emulsion was prepared in the following manner. Solutions I', II', III' and IV' were prepared. Solutions II' III' and IV' were added to solution I' kept at 70° C. according to the triple jet process, Solution II' was added thereto at a constant flow rate of 2.5 ml/min in 40 minutes. Addition of solution III' was started simultaneously with the addition of solution II' while controlling the flow rate so that the pAg was 8.7 in the first 5 minutes, then 7.2 in the subsequent 35 minutes and, upon completion of the addition of solution II', addition of solution III' was discontinued. Addition of solution IV' was started 5 minutes after initiation of the addition of solutions II' and III' and was conducted at a constant flow rate of 25.0 ml/min so as to complete addition of IV' in 20 minutes. After completion of the addition of the solutions, the emulsion was washed with water according to the conventional flocculation process to desalt, then 100 g of gelatin was added thereto per mol of silver halide. After dissolving at 40° C., the pAg of the emulsion was adjusted to 8.9 with KBr, and the pH was adjusted to 7.0 with NaOH. Thereafter, the emulsion was heated to 75° C., and 300 mg of the same spectrally sensitizing die I and 30 mg of II as used in Example 1 were added thereto per mol of silver halide. Further, 40 mg of sodium thiosulfate and 40 mg of chloroauric acid tetrahydrate were added thereto per mol of silver halide, followed by ripening the emulsion for 50 minutes to conduct spectral sensitization and chemical sensitization. The thus-obtained emulsion was a cubic mono-disperse emulsion of about 0.35 μm in side length.

| | |
|---|---|
| Solution I': 75° C. | |
| Gelatin | 20 g |
| KBr | 4 g |
| Phosphoric acid aqueous solution (10%) | 2 ml |
| Sodium benzenesulfinate | $5 \times 10^{-2}$ mol |
| 2-Mercapto-3-4-methylthiazole | $1 \times 10^{-2}$ mol |
| Water to make | 1000 ml |
| Solution II': 50° C. | |
| Silver nitrate | 160 g |
| Water to make | 1000 ml |
| Solution III': 50° C. | |
| KBr | 220 g |
| Water to make | 1000 ml |
| Solution IV': 50° C. | |
| KI | 2.5 g |
| Water to make | 500 ml |

To the above-described emulsion the following were added: gelatin, 4-hydroxy-6-methyl-1,3,3,3a-tetrazaindene (as a stabilizer), 1,3-divinylsulfonyl-2-propanol (as a hardener), and sodium p-dodecylbenzenesulfonate (as a coating aid) and, further, a compound of formula (I) was added thereto. The resulting emulsion was coated on a 100 μm thick polyethylene terephthalate film having a conductive coat composed of Sb-containing $SnO_2$. Upon this coating, a surface-protecting layer of 1.0 μm in thickness was simultaneously coated on the emulsion layer, and a gelatin layer of 0.5 μm in thickness was simultaneously coated between the emulsion layer and the film.

The coating solution for forming the surface-protecting layer was prepared by adding barium strontium sulfate (as a matting agent), a liquid paraffin (as a slipping agent), colloidal silica (as a scratch-preventing agent) and sodium p-dodecylbenzenesulfonate (as a coating aid) to a gelatin aqueous solution.

The coating solution for forming the gelatin layer was prepared by adding sodium p-dodecylbenzenesulfonate as a coating aid to a gelatin aqueous solution.

In order to prepare samples of emulsion layers (protective layer, emulsion layer, gelatin layer, etc.) different in swelling ratio, the amount of the hardener was varied. The term "swelling ratio" as used herein means a quotient calculated by dividing the swollen amount (thickness after swelling − thickness before swelling) by the thickness of layer before swelling.

Imagewise exposure, reversal development processing and evaluation of coated samples were conducted in the same manner as in Example 1. The results thus obtained are tabulated in Table 6.

TABLE 6

| Sample | Compound of Formula (I) (0.25 mg/m²) | Swelling Ratio (%) | Sensitivity* Fresh Soln. | Sensitivity* Fatigued Soln. | Dmax Fresh Soln. | Dmax Fatigued Soln. |
|---|---|---|---|---|---|---|
| A' | — | 200 | 102 | 105 | 2.10 | 1.88 |
| B' | — | 160 | 100 | 107 | 2.05 | 1.93 |
| C' | — | 120 | 95 | 102 | 1.86 | 1.66 |
| D' | (1) | 200 | 145 | 2.12 | 1.91 | 1.91 |
| E' | " | 160 | 141 | 145 | 2.08 | 200 |
| F' | " | 120 | 138 | 138 | 1.90 | 171 |
| G' | (2) | 200 | 138 | 141 | 2.11 | 1.89 |
| H' | " | 160 | 135 | 135 | 2.06 | 1.99 |
| I' | " | 120 | 135 | 138 | 1.91 | 1.70 |
| J' | (3) | 200 | 132 | 135 | 2.09 | 1.87 |
| K' | " | 160 | 132 | 132 | 2.07 | 1.97 |
| L' | " | 120 | 129 | 132 | 1.89 | 1.71 |

(Note)* Sensitivity values are presented in terms of relative values of exposure amounts giving a density of fog +1.2 (taking the sensitivity of B' as 100).

It is seen from the above results that the samples of the present invention possess a high sensitivity and undergo less decrease in Dmax when processed with the fatigued solution.

While the invention has been described in detail and with reference to specific embodiments thereof, it is apparent to one skilled in the art that various changes and modifications can be made therein without departing from the spirit and scope of the present invention.

What is claimed is:

1. A silver halide photographic material for reversal processing, which comprises a support having provided thereon at least one hydrophilic colloidal layer, said at least one hydrophilic colloidal layer is a light-sensitive silver halide emulsion layer, silver halide grains of said silver halide emulsion are of a core/shell structure comprising a core portion and a shell portion, and said core portion is substantially composed of silver bromide and said shell portion is composed of two layers, with the first shell portion in contact with said core portion substantially comprising silver bromoiodide and the second shell portion outside the first shell portion substantially comprising silver bromide, wherein the difference in silver iodide content between the two shell portions is less than 6 mol % and wherein said shell portion contains 0.5 to 6 mol % of silver iodide.

2. The silver halide photographic material as in claim 1, wherein said core portion has a size of 0.1 to less than 0.2 μm.

3. The silver halide photographic material as in claim 1, wherein the molar ratio of silver amount of the core portion to that of the shell portion ranges from 1/1 to 1/10.

4. The silver halide photographic material as in claim 1, wherein said first shell portion contains 1.0 to 5.0 mol % of silver iodide.

5. The silver halide photographic material as in claim 1, wherein said first shell portion and said second shell portion account for 30 to 50 mol % and 30 to 40 mol %, respectively, based on the whole grain.

6. The silver halide photographic material as in claim 1, wherein said silver halide grain has a size of 0.1 to 1.0 μm and contains 0.5 to 5 mol % of silver iodide based on the whole grain.

7. The silver halide photographic material as in claim 6, wherein said silver halide grains are monodisperse grains having coefficient of variation of up to 20%.

8. The silver halide photographic material as in claim 1, wherein said emulsion layer of other hydrophilic layer contains a compound represented by formula (I):

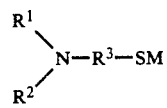

(I)

wherein $R^1$ and $R^2$ each represents a hydrogen atom or an aliphatic residue or may be bound to each other to form a ring, $R^3$ represents a divalent aliphatic group, and M represents a hydrogen atom, an alkali metal atom, an alkaline earth metal atom, a quaternary ammonium salt, a quaternary phosphonium salt or an amidino group.

9. The silver halide photographic material as in claim 8, wherein said aliphatic residue for $R^1$ and $R^2$ is an alkyl, alkenyl or alkynyl group containing up to 12 carbon atoms and said divalent aliphatic group for $R^3$ has 1 to 6 carbon atoms.

10. The silver halide photographic material as in claim 9, wherein said $R^1$ and $R^2$ each represents a hydrogen atom or an alkyl group having 1 to 3 carbon atoms and said $R^3$ represents a divalent aliphatic group having 2 to 4 carbon atoms.

11. The silver halide photographic material as in claim 8, wherein said compound is contained in an amount of 0.05 to 5 mg/m².

12. The silver halide photographic material as in claim 8, wherein said compound is contained in the emulsion layer.

13. The silver halide photographic material as in claim 1, wherein said silver halide grain is coated in a silver amount of 0.5 to 5.0 g/m².

* * * * *